US009339859B2

(12) United States Patent
Miller

(10) Patent No.: US 9,339,859 B2
(45) Date of Patent: May 17, 2016

(54) RECIPROCATING DEVICES FOR FORMING, FOLDING, AND/OR HEMMING AND METHODS THEREFOR

(75) Inventor: Brett Miller, Corona, CA (US)

(73) Assignee: Thermal Structures, Inc., Corona, CA (US)

( * ) Notice: Subject to any disclaimer, the term of this patent is extended or adjusted under 35 U.S.C. 154(b) by 1190 days.

(21) Appl. No.: 13/157,677

(22) Filed: Jun. 10, 2011

(65) Prior Publication Data

US 2011/0302985 A1 Dec. 15, 2011

Related U.S. Application Data

(60) Provisional application No. 61/353,798, filed on Jun. 11, 2010.

(51) Int. Cl.

| | |
|---|---|
| ***B21D 5/01*** | (2006.01) |
| ***B21D 5/02*** | (2006.01) |
| ***B21D 5/16*** | (2006.01) |
| *B21D 39/02* | (2006.01) |

(52) U.S. Cl.
CPC .. *B21D 5/02* (2013.01); *B21D 5/16* (2013.01); *B21D 39/02* (2013.01)

(58) Field of Classification Search
CPC ..... B21D 5/01; B21D 5/02; B21D 5/0209; B21D 5/16; B21D 11/20; B21D 19/00; B21D 19/08; B21D 39/04; B21D 39/02
USPC ..... 72/312, 373–376, 322, 323, 386, 48, 72/389.1, 313–315
See application file for complete search history.

(56) References Cited

U.S. PATENT DOCUMENTS

| | | | | |
|---|---|---|---|---|
| 3,071,176 | A | 1/1963 | Askinazy | |
| 4,803,879 | A * | 2/1989 | Crawford | 72/322 |
| 4,805,438 | A | 2/1989 | Ginn, Jr. et al. | |
| 4,928,388 | A | 5/1990 | Dacey, Jr. | |
| 5,404,742 | A | 4/1995 | Wilson et al. | |
| 5,454,261 | A | 10/1995 | Campian | |
| 5,555,763 | A * | 9/1996 | Takeshita | 72/420 |
| 5,761,940 | A * | 6/1998 | Moore et al. | 72/19.4 |
| 5,878,618 | A * | 3/1999 | Stalzer | 72/452.9 |
| 6,079,250 | A | 6/2000 | Scannell et al. | |
| 6,341,243 | B1 * | 1/2002 | Bourne | B21D 5/02 72/420 |
| 6,672,127 | B2 * | 1/2004 | Maida | 72/389.4 |
| 6,832,526 | B2 * | 12/2004 | Koyama et al. | 73/849 |

(Continued)

FOREIGN PATENT DOCUMENTS

| | | |
|---|---|---|
| EP | 0665070 | 11/2001 |
| EP | 1503873 | 3/2007 |

(Continued)

OTHER PUBLICATIONS

JP 06087028 A machine translation.*

*Primary Examiner* — Shelley Self
*Assistant Examiner* — Pradeep C Battula
(74) *Attorney, Agent, or Firm* — Fish & Tsang LLP

(57) ABSTRACT

A hem is formed in two abutting surfaces of a work piece in a two-pass process in which the work piece is pre-hemmed by a reciprocating tool in a first pass and in which the hem is then formed from the pre-hem by the same reciprocating tool in a second pass upon inversion of the work piece. In especially preferred aspects, the reciprocating tool has an angled contact surface that cooperates with a corresponding static tool.

9 Claims, 3 Drawing Sheets

(56) References Cited

U.S. PATENT DOCUMENTS

| | | | | |
|---|---|---|---|---|
| 7,204,118 | B2 | 4/2007 | Wiens et al. | |
| 7,497,338 | B2 * | 3/2009 | Garrett et al. | 209/381 |

FOREIGN PATENT DOCUMENTS

| | | | |
|---|---|---|---|
| GB | 2403924 | | 9/2005 |
| JP | 06087028 | A * | 3/1994 |

* cited by examiner

RECIPROCATING DEVICES FOR FORMING, FOLDING, AND/OR HEMMING AND METHODS THEREFOR

This application claims the benefit of our provisional application with the Ser. No. 61/353798, which was field Jun. 11, 2010, and which is incorporated by reference herein.

FIELD OF THE INVENTION

The field of the invention is manufacturing equipment and methods for folding and/or hemming various materials, and especially thin metal/sheet metal.

BACKGROUND OF THE INVENTION

Manufacture of most metal products typically requires various forming and folding operations of metal foils or sheets, and numerous types of equipment are known in the art to perform such tasks. Unfortunately, most of the known metal forming devices and methods have numerous disadvantages or are not even capable of hemming where the edge of one or more pieces of metal are folded back onto themselves. To circumvent such difficulties, specialized equipment can be used.

For example, a series of wheels can be employed to sequentially form a hem as described in GB 2 403 924. Alternatively, where wheel operation is not desirable or impractical, single die devices with a curved die surface can be used as taught in U.S. Pat. No. 7,204,118. However, such devices typically require an already angled sheet. Similar difficulties arise with devices as shown in EP 1 503 873 B1 where a preformed die with a curved surface is used to guide edge movement and where a second die is used to flatten the hem. In still other known methods, a compound flanging and hemming die is employed to hem two sheets together as shown in U.S. Pat. No. 5,454,261.

Alternatively, one or more rotary bending tools can be employed as depicted in U.S. Pat. No. 5,404,742, and U.S. Pat. No. 3,071,176 discloses a folding machine in which the leading portion of a metal sheet is first pressed into an angled groove to form a partially folded edge that is then completely folded via an anvil. Alternatively, dual moving elements may are used to hem sheets of metal as described in U.S. Pat. No. 6,079,250.

While such devices are often satisfactory for their relatively specialized tasks, they tend to lack satisfactory performance where metal foil encapsulated insulation products are produced that require hemming of edges that are often not straight. Moreover, additional difficulties are found where the metal edge that is to be hemmed is directly adjacent to the body of the work piece. In such cases, folding or hemming is most commonly performed using a pair of pliers, which is not only extremely difficult and time consuming, but also impedes efficient production flow.

Thus, even though numerous metal forming devices are known in the art, there is still a need to provide improved devices and methods for hemming, especially where edges are curved and/or where the hem is in close proximity to the work piece.

SUMMARY OF THE INVENTION

The present invention is directed towards methods and devices for metal forming, and particularly for hemming one or more layers of metallic material (e.g., sheet metal or otherwise thin metal structures). Most preferably, the methods and devices contemplated herein employ a reciprocating tool that cooperates with a preferably static second tool to form a first angled intermediate that is then repositioned (most typically inverted) relative to the tool and further processed with the reciprocating tool using again the preferably static second tool to form the final structure. Alternatively, the further processing can also use a second pair of tools in a position that is inverted relative to the first pair of tools.

In especially preferred methods and devices, the first tool has a first angled contact surface, and the second tool has a second angled contact surface, wherein first and second tools and first and second contact surfaces are arranged relative to each other such that a work piece pressed between the first and second contact surfaces forms a first angle, and the work piece, when inverted and pressed between the first and second contact surfaces increases the first angle to a second angle, wherein the second angle is greater than 170 degrees.

In one embodiment according to the inventive subject matter, a forming device comprises a reciprocating first tool having a first angled contact surface, and a second tool having a second angled contact surface; wherein first and second tools and first and second contact surfaces are shaped and arranged relative to each other such that (a) first and second contact surfaces, upon approximating each other, are capable of deforming two abutting surfaces of a work piece to generate a first angle in the two abutting surfaces; and (b) first and second contact surfaces, upon approximating each other, are capable of increasing the first angle to a second angle of at least 170 degrees when the two abutting surfaces are inverted relative to the first and second tools.

Most typically, it is preferred that the second tool is static relative to the first tool, and that at least one of the first and second angled contact surfaces are stepped at a step angle that corresponds to the first angle. While not limiting to the inventive subject matter, it is also preferred that the first and second angled contact surfaces have a first and second width, respectively, that the abutting surfaces have a longest dimension L, and that L is at least ten times the length of the first and second widths. Therefore, the first and second contact surfaces have a relatively small width compared to the lengthy of the hem (e.g., width of less than 5 cm).

It is further contemplated that the device is configured such as to allow reciprocating of the first tool at a rate of at least 5 Hz, and more typically at least 20 Hz (e.g., using a pneumatic actuator for the reciprocating first tool). Additionally, contemplated devices may include a mechanism that is configured to allow lateral guidance of the work piece past the reciprocating first tool, and/or may further include third and fourth tools having third and fourth respective contact surfaces that are shaped and arranged relative to each other such that third and fourth contact surfaces, upon approximating each other, are capable of increasing the first angle to a second angle of at least 170 degrees. Where desirable, first and/or second tools may be configured to allow formation of a resistance weld in the work piece.

Consequently, a method of hemming together two layers of a metallic material to produce a hem having a length L will include a step of using a reciprocating first tool having a first angled contact surface, and a second tool having a second angled contact surface is used to form a first angle in a first portion of the two layers of the metallic material. Most preferably, the first and second angled contact surfaces have respective first and second widths, and L is at least ten times the length of at least one of the first and second widths. In another step, the two layers of the metallic material are laterally moved along the first and second angled contact surfaces and the reciprocating tool is used to form the first angle in a second portion of the two layers of the metallic material, wherein the first and second portions are adjacent or at least partially overlapping. A second angle is then formed in the first portion of the two layers of the metallic material using first and second angled surfaces of the first and second tools.

Most preferably, the first and second tools are configured to allow formation of a curved hem (e.g., the first and second widths of the first and second angled contact surfaces measure equal or less than 5 cm), and/or the reciprocating first tool reciprocates at a rate of at least 5 Hz. Where desired, it is further contemplated that the methods presented herein will further include a step of forming a resistance weld in the two layers of the metallic material using the first and second tools. It is still further preferred that the step of laterally moving is assisted by a lateral guide mechanism. Additionally, the step of forming the second angle may be preceded by a step of inverting the two layers of the metallic material relative to the first and second angled surfaces of the first and second tools.

Therefore, and viewed from another perspective, a method of hemming together two layers of a metallic material to produce a hem having a length L will include a step of incrementally and laterally moving the two layers of the metallic material along first and second angled contact surfaces of respective first and second tools while the first tool reciprocally moves against the second tool to so form a first angle in at least a portion of the two layers of the metallic material. In another step, the two layers of the metallic material are then inverted relative to the first and second angled surfaces of the first and second tools, and in yet another step, a second angle is formed in at least a portion of the two layers of the metallic material using first and second angled contact surfaces of the first and second tools. Most typically, the first and second angled contact surfaces have respective first and second widths, wherein L is at least ten times the length of at least one of the first and second widths. It is further preferred that the first tool reciprocally moves at a frequency of at least 5 Hz.

Various objects, features, aspects and advantages of the present invention will become more apparent from the following detailed description of preferred embodiments of the invention along with the accompanying drawing.

DETAILED DESCRIPTION

The inventor has discovered that numerous materials, and especially metallic materials can be folded and/or hemmed in a conceptually simple and effective manner using the inventive devices and methods presented herein that also allow folding or hemming in places that would otherwise not be accessible due to curvature and/or proximity of the fold or hem to the work piece.

In especially contemplated aspects, a forming device includes a reciprocating first tool with a first angled contact surface, and a preferably static second tool with a second angled contact surface, wherein the tools and contact surfaces are shaped and arranged relative to each other such as that the contact surfaces, upon approximating each other, can deform two abutting surfaces of a work piece to so generate a first angle in the abutting surfaces. Moreover, the contact surfaces are also shaped and arranged such that, upon approximating each other, the surfaces will increase the first angle to a second angle (typically at least 170 degrees) when the two abutting surfaces are inverted relative to the first and second tools. It should be noted that in most cases an operator will invert the work piece with the abutting surfaces while the positioning of the tools remains the same. However, it is also noted that the work piece with the abutting surfaces may be held in the same orientation, and that the tools are then inverted in position. In yet further contemplated aspects, a second set of tools (e.g., one reciprocating, the other static) is positioned near the first set of tools, albeit in an inverted position. Thus, in such configurations, no inversion of the work piece or tools is required.

Figure 1:
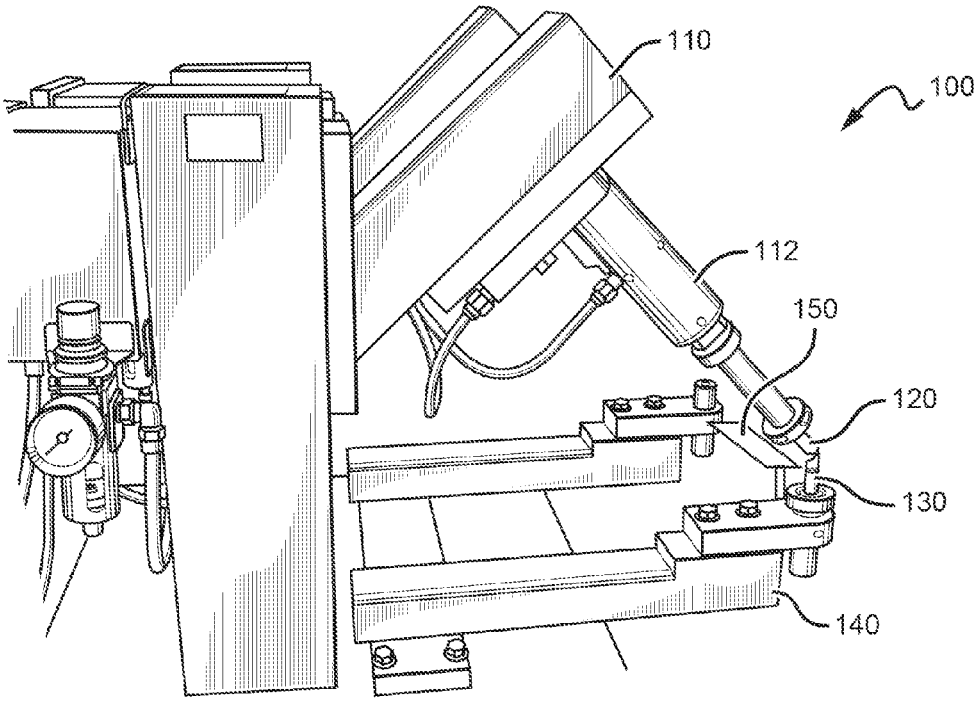
FIG. 1 is a drawing of an exemplary device according to the inventive subject matter.

One exemplary device is depicted in the drawing of FIG. 1. Here, device 100 has a first arm 110 on which reciprocating first tool 120 is mounted via pneumatic actuator 112. Static tool 130 is mounted on second arm 140. Behind first and second arms 110 and 140 are third and fourth arms with pneumatic actuator that are suitable for retention of respective tools in an inverted position (such that the work piece need not be inverted). Alternatively, the third and fourth arm can also be configured to operate identically as first and second arms, typically then in an independent manner. Guide rail 150 serves as a guide mechanism to allow lateral guidance of the work piece past the reciprocating first tool.

Figure 2A:
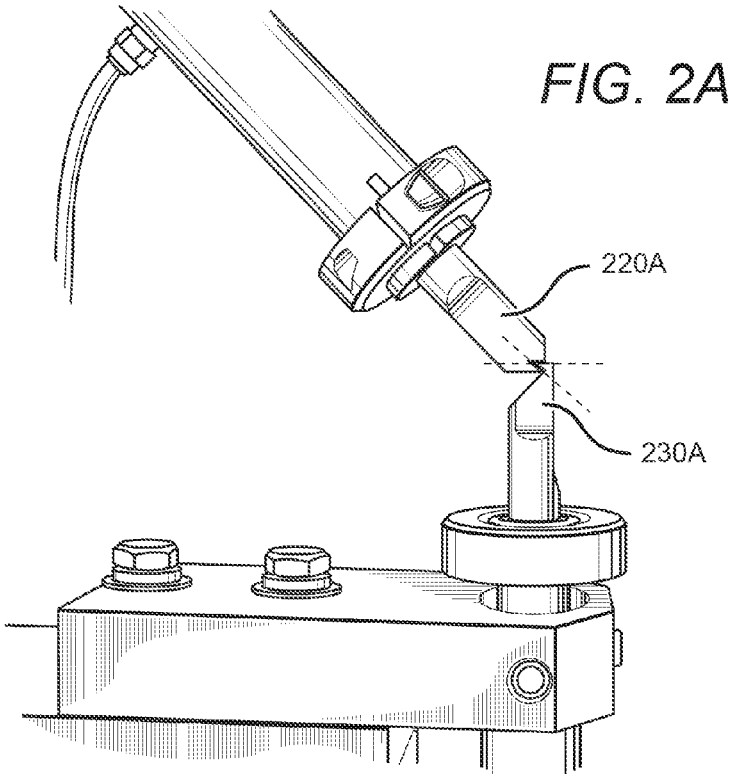
FIGS. 2A and 2B are detail views of the device of FIG. 1.
Figure 2B:
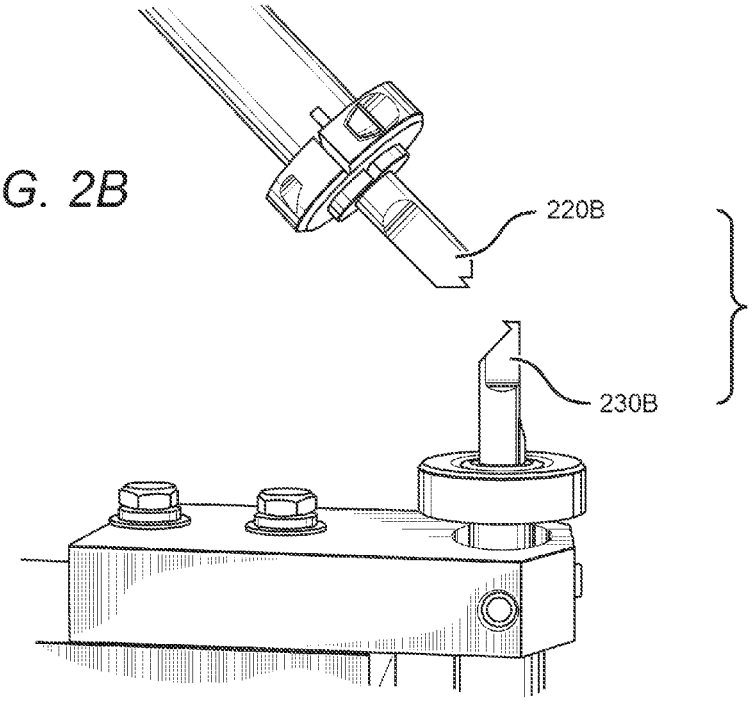
Figure 3:
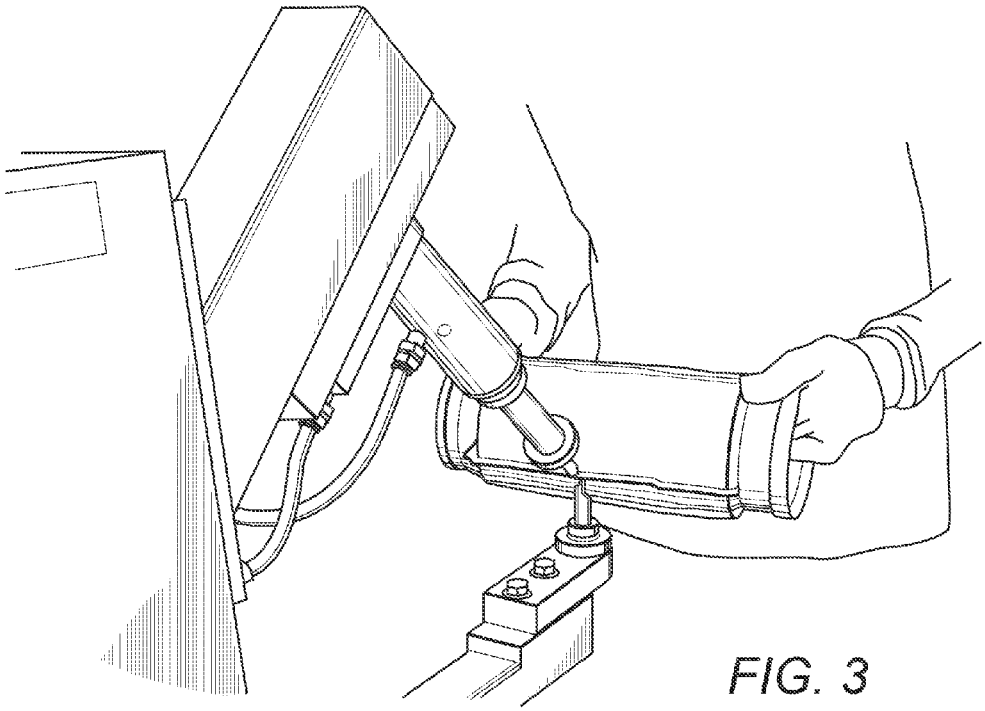
FIG. 3 shows the device of FIG. 1 in operation.

FIG. 2A shows a detail view of the device of FIG. 1 in which the first tool 220A and the second tool 230A contact each other with the angled contact surfaces. The dotted line depicts the first angle that is formed upon approximation of the tools as can also be seen from FIG. 2B in which the first and second tools are in an open configuration. Here, the angled contact surfaces of tools 220B and 230B are readily apparent. FIG. 3 is a drawing showing the exemplary device of FIG. 1 in operation. Here, a work piece comprises a steel tube and a metallic film that covers insulating material surrounding the steel tube, wherein overlapping ends of the metal film are hemmed together by first incrementally and laterally moving the abutting surfaces of the metallic film along the angled surfaces of the first and second tools to form a first angle (here: pre-hem)in the abutting surfaces. The work piece is then inverted relative to the first and second tool and again incrementally and laterally moved along the angled surfaces of the first and second tools to form a second angle (here: complete hem) in the abutting surfaces.

Figure 4:
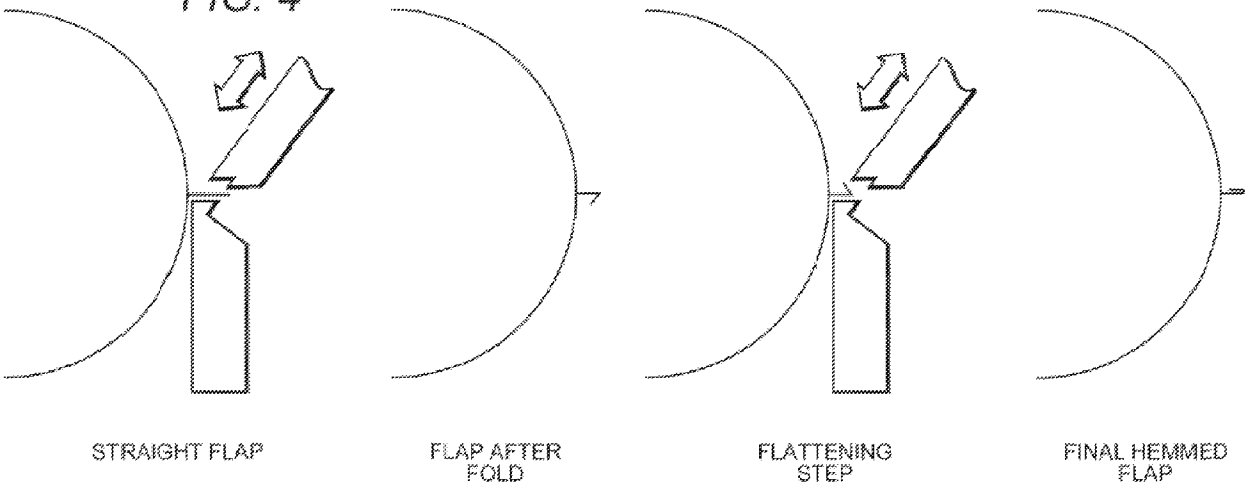
FIG. 4 is a schematic illustration of workflow using methods and devices according to the inventive subject matter.

In the exemplary use of FIG. 3, the work piece is a tube which has been previously insulated and encapsulated by stainless steel foil such that a flap (formed from two abutting end portions of the steel foil) protrudes radially from the side of the encapsulation. FIG. 4 depicts in more detail one possible sequence of operation of the device. In this case it is desirable to fold the flap into a hem. Holding the work piece, the operator first rests the flap on the second static tool such that the flap extends over at least a portion of the angled surface of the static tool, preferably by less than half of the overall width of the flap as shown in the first panel. As the first reciprocating tool is driven towards the second static tool, the extending portion of the metal flap is forced down past 90 degrees (or any other predetermined angle according to the particular shape of the angled contact surfaces of the first and second tools) as shown in the second panel. The operator repeats this folding operation by laterally and incrementally moving the work piece past the first and second tool surfaces along the length of the flap. Once the entire length of the flap is folded past 90 degrees, the operator then completes the hem by inverting the work piece relative to the tools such that the fold is now facing upwards as shown in the third panel. The folded flap then rests on the second static tool as before, and the reciprocating tool that was used to fold (as seen in the first panel) is now used in the same arrangement (i.e., without change in position or orientation) to push the folded portion of the flap all the way over and to so form a flattened hem in only two steps.

Therefore, it should be appreciated that two or more (preferably abutting) layers of a metallic material can be hemmed together by incrementally and laterally moving the two layers of the metallic material along first and second angled contact surfaces of respective first and second tools while the first tool reciprocally moves against the second tool to so form a first angle in at least a portion of the two layers of the metallic material. The two layers are then inverted (relative to the first and second angled surfaces of the first and second tools) and a second angle is formed using the same (or different) set of tools using angled contact surfaces of the tools. Among other options, it is typically preferred that a reciprocating first tool with a first angled contact surface and a second (typically static) tool with a second angled contact surface is used to form a first angle in a first portion of the two layers of the metallic material. While not limiting to the inventive subject matter, it is generally preferred that the first and second angled contact surfaces have respective first and second widths that are significantly smaller than the length of the hem or fold that is to be produced. For example, it is generally preferred that the length of the hem or fold is at least five times, more typically at least ten times, and most typically at least fifty times the length of the first and/or second widths. Thus, by laterally moving the two layers of the metallic material along the first and second angled contact surfaces, the reciprocating tool will form the first angle in a second portion (adjacent or at least partially overlapping) of the two layers of the metallic material. The hem can then be completed by forming a second angle in the first portion of the two layers of the metallic material using first and second angled surfaces of the first and second tools (or third and fourth angled surfaces of the third and fourth tools, which are preferably in an inverted position relative to the first and second angled surfaces).

It should be appreciated that contemplated devices employ reciprocal motion of at least one tool and further employ specially designed tools to create folds, forms, and hemmed edges. In most typical embodiments, the device includes a frame on which an actuator (e.g., pneumatic cylinder) is mounted, typically at a downwardly angle of about 45 degrees. Coupled to the actuator is a hardened steel tool as the reciprocating first tool. Also mounted to the frame, most typically in vertical orientation, is a second (preferably static) tool, typically made from hardened steel. Under most circumstances, the actuator allows for reciprocal motion of the first tool at a desired frequency, preferably between 2 and 200 Hz, and most preferably between 5 and 50 Hz. It is generally preferred, as can be seen in the exemplary device of FIG. 1, that the first tool and the second tool are shaped and spatially arranged to each other such that when, forced together with a material between the tools, the tools will create a fold in the material that is nearly 135 degrees from horizontal. Thus, the first and second tools are oriented such that the angled contact surface of the first reciprocating tool strikes the contact surface of the second tool at an angle which is 45 degrees from vertical. Of course, it should be appreciated that numerous other angles are also deemed suitable, so long as such angles will allow hemming using the same first and second tools. However, it is generally preferred that the fold angle is greater than 90 degrees, and more typically at least 110 degrees.

It should be particularly appreciated that as the first and second tools can be made as thin as desired, contemplated devices allow hemming along edges with various curves, contours, and/or corners. Moreover, such devices and methods also makes it very easy to stop and start the hem at any position along the length of an edge. For example, suitable widths of contact surfaces can measure between 0.1 cm to 0.5 cm, between 0.5 cm to 1.0 cm, between 1 cm to 2 cm, between 2 cm to 5 cm, or between 5 cm to 10 cm (and in some cases even wider).

Consequently, and viewed from one perspective, a device is contemplated that includes a reciprocating first tool with a first angled contact surface, and a second tool with a second angled contact surface. In such devices, first and second tools and first and second contact surfaces are arranged relative to each other such that a work piece that is pressed between the first and second contact surfaces forms a first angle (typically greater than 90 degrees), and such that the work piece, after being inverted and pressed between the first and second contact surfaces increases the first angle to a second angle (typically greater than 170 degrees).

Most preferably, the second tool is a static tool. However, in alternative aspects, the second tool may also be implemented as a reciprocating tool. With respect to the contacting surfaces it is generally preferred that the contact surfaces of the first and second tool are at least in part complementary to each other and have a stepped configuration. Most preferably, the step angle will be the same as the first angle. Additionally, it is preferred that the contact surface of the second tool has a portion that supports a portion of the work piece but does not crimp or otherwise deform the work piece. Most typically, but not necessarily, the support portion will be again in a complementary shape to at least part of the contact surface of the first tool.

As already noted above, the width of the contact surface will typically be less than 100 cm, more typically less than 10 cm, and even more typically less than 5 cm. Thus, especially preferred widths include those between 0.5 cm and 1 cm, between 1 cm and 3 cm, and between 3 cm and 5 cm. Additional features may be implemented in the contact surfaces or other portions of the tools. For example, the contact surfaces may have an impression or other structure to impress a company logo. Alternatively, or additionally, the tools may be configured to also allow for resistance welding of the hem where desirable. Still further, the contact surfaces may also include a sharpened edge such that the tools can also be used to cut the metallic material in a desired fashion.

With respect to the reciprocating motion, it is generally preferred that the motion is only along a single axis (i.e., truly reciprocating). However, alternative motions along two or even three axes are also deemed suitable, especially where the reciprocating motion is conveyed from a wheel or an eccentric wheel. Moreover, while numerous reciprocating speeds are deemed suitable, especially preferred speeds are faster than 1 Hz, more typically faster than 5 Hz, and most typically faster then 20 Hz (e.g., up to and above 100 Hz, or 200 Hz, and even 300 Hz). In further contemplated aspects, it should be appreciated that reciprocating speeds could also be below 1 Hz, or even be entirely determined by an operator (e.g., via trigger) on a cycle-by-cycle basis to so allow for exact control. Therefore, suitable control mechanisms for actuators include electronic control circuits, pneumatic control circuits, and manual operator control (e.g., via switch or valve). Likewise, it should be noted that the amplitude of the reciprocating motion (e.g., reciprocating distance during folding/hemming operation) need not be large so long as the first and second tools allow lateral movement of the metallic materials between the first and second tools. Thus, typical reciprocating amplitudes are between 1 mm and 5 mm, between 5 mm and 1 cm, and between 1 cm and 5 cm (and in some cases even more).

Depending on the strength and resiliency of the material, numerous actuators may be employed for the reciprocating motion. However, it is generally contemplated that the materials that are to be hemmed are relatively flexible. For example, especially contemplated materials include metal plates and foils with a thickness of equal or less than 2 mm, and more typically equal or less than 1 mm. Such materials may further be corrugated, perforated, or even laminated to yet other materials. Thus, hydraulic, pneumatic, and/or electromagnetic actuators are deemed suitable for use herein. Additionally, it is contemplated that the devices presented herein will also include a mechanism that is configured to allow lateral guidance of the work piece past the reciprocating first tool, wherein such guidance may be passive (e.g., configured as a guide rail or slot) or active (e.g., configured as a pair of engaging transport wheels, transport track, etc.)

Figure 5:
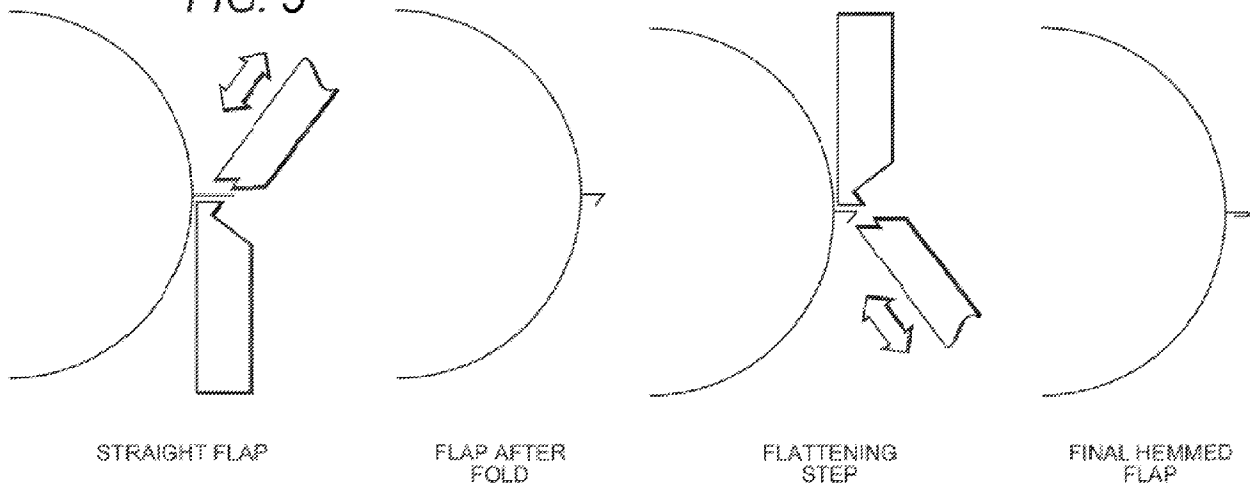
FIG. 5 is a schematic illustration similar to FIG. 4, but it includes a set of inverted work tools to obviate the need for workpiece inversion.

Of course, it should be appreciated that the devices and contemplated herein are merely exemplary aspects of the inventive concept presented herein. For example, suitable devices may be configured as hand held devices, use a different manner of reciprocation, orient the tooling at different angles, and/or use different first and second tool combinations to perform different folding tasks. Furthermore, as shown in FIG. 5, it should be noted that contemplated devices also include those having multiple tools, optionally with opposite orientation such that inversion of the work piece is eliminated. Likewise, the work piece may vary considerably and will depend on the particular configuration of the device and tools.

Thus, specific embodiments and applications of devices and methods of forming, folding, and/or hemming have been disclosed. It should be apparent, however, to those skilled in the art that many more modifications besides those already described are possible without departing from the inventive concepts herein. The inventive subject matter, therefore, is not to be restricted except in the spirit of the appended claims.

What is claimed is:

1. A forming device operable upon at least one workpiece, collectively having first and second ends, comprising:

a first tool having a first angled contact surface and a second tool having a second angled contact surface that is complementary to the first angled contact surface;

wherein the first tool and the second tool are reciprocally operable with respect to one another such that the first angled contact surface and the second angled contact surface cooperate to simultaneously bend the first and second ends into a first bend of less than 170 degrees, wherein the first tool has a central axis and reciprocates along the central axis which is at an angle relative to a central axis of the second tool and the first tool having a third angled contact surface and the second tool having a fourth angled contact surface that is complementary to the third angled contact surface;

wherein the first tool and the second tool are reciprocally operable with respect to one another such that the third angled contact surface and the fourth angled contact surface cooperate to simultaneously increase an angle of the first bend to at least 170 degrees upon inversion of the workpiece relative to the first and second tools.

2. The forming device of claim 1 wherein the second tool is static relative to the first tool.

3. The forming device of claim 1 wherein at least one of the first and second angled contact surfaces are stepped at a step angle that corresponds to an angle of the first bend.

4. The forming device of claim 1 wherein the first and second angled contact surfaces have a first and second width, respectively, wherein the first and second ends of the work piece have a length dimension L, and wherein L is at least ten times the length of the first and second widths.

5. The forming device of claim 1 wherein the first and second contact surfaces have a width of less than 5 cm.

6. The forming device of claim 1 wherein the device is configured to allow reciprocating of the first tool at a rate of at least 20 Hz.

7. The forming device of claim 1 wherein the device comprises a pneumatic actuator for the reciprocating first tool.

8. The forming device of claim 1 further comprising a mechanism that is configured to allow lateral guidance of the work piece past the reciprocating first tool.

9. The forming device of claim 1 further comprising third and fourth tools having fifth and sixth respective angled contact surfaces that are shaped and arranged relative to each other where the third tool reciprocates relative to the fourth tool such that fifth and sixth contact surfaces, upon reciprocation, increase the first angle of the first bend to at least 170 degrees without requiring inversion of the workpiece.

* * * * *